US006102713A

United States Patent [19]

Todd, Jr.

[11] Patent Number: 6,102,713

[45] Date of Patent: Aug. 15, 2000

[54] RECEPTACLE GROUNDING WIRE

[75] Inventor: James H. Todd, Jr., Concord, N.C.

[73] Assignee: Pass & Seymour, Inc., Syracuse, N.Y.

[21] Appl. No.: 09/275,322

[22] Filed: Mar. 24, 1999

[51] Int. Cl.[7] ..... H01R 13/74

[52] U.S. Cl. ..... 439/107

[58] Field of Search ..... 439/107, 539; 174/51

[56] References Cited

U.S. PATENT DOCUMENTS

| | | |
|---|---|---|
| Re. 29,752 | 9/1978 | Jaconette, Jr. . |
| 2,372,884 | 9/1945 | Davis . |
| 2,713,186 | 7/1955 | Borowsky . |
| 2,772,560 | 12/1956 | Neptune . |
| 3,064,224 | 11/1962 | Wiley . |
| 3,403,215 | 9/1968 | Slater et al. . |
| 3,403,216 | 9/1968 | Drapkin . |
| 3,403,217 | 9/1968 | Drapkin . |
| 3,403,218 | 9/1968 | Norden . |
| 3,432,793 | 3/1969 | Muska et al. . |
| 3,617,611 | 11/1971 | Kuether . |
| 3,639,884 | 2/1972 | Drapkin . |
| 3,659,246 | 4/1972 | Martin . |
| 3,663,919 | 5/1972 | Jaconette . |
| 3,671,916 | 6/1972 | Opalenik . |
| 3,680,031 | 7/1972 | Schumacher . |
| 3,688,239 | 8/1972 | Jaconette . |
| 3,713,071 | 1/1973 | Poliak et al. . |
| 3,723,939 | 3/1973 | Schleicher . |
| 3,723,941 | 3/1973 | Schumacher et al. . |
| 3,723,942 | 3/1973 | Dennison . |
| 3,784,953 | 1/1974 | Lingaraju . |
| 3,786,399 | 1/1974 | McHattie . |
| 3,806,856 | 4/1974 | Virani et al. . |
| 3,810,069 | 5/1974 | Jaconette, Jr. . |
| 3,967,049 | 6/1976 | Brandt . |
| 4,039,235 | 8/1977 | Thibeault . |
| 4,203,638 | 5/1980 | Tansi . |
| 4,406,505 | 9/1983 | Avramovich . |
| 4,552,421 | 11/1985 | Drapkin . |
| 4,668,034 | 5/1987 | McHattie et al. . |
| 4,745,523 | 5/1988 | Moreau et al. . |
| 4,793,059 | 12/1988 | Moreau et al. . |
| 4,836,793 | 6/1989 | Munroe . |
| 4,865,556 | 9/1989 | Campbell et al. . |
| 5,044,983 | 9/1991 | Mahaney et al. . |
| 5,146,385 | 9/1992 | Misencik . |
| 5,451,167 | 9/1995 | Zielinski et al. . |

*Primary Examiner*—Gary F. Paumen
*Attorney, Agent, or Firm*—Bond Schoeneck & King

[57] ABSTRACT

A wiring device such as a receptacle is adapted to be mounted to a wall box and includes a spring wire to ensure a satisfactory ground connection between the device, the wall box, and the screws which mount the device to the wall box. The wiring device includes a spring wire extending across the screw receiving aperture in the mounting strap of the device. The spring wire is retained in openings in a pair of attachment members adjacent the screw receiving aperture.

15 Claims, 3 Drawing Sheets

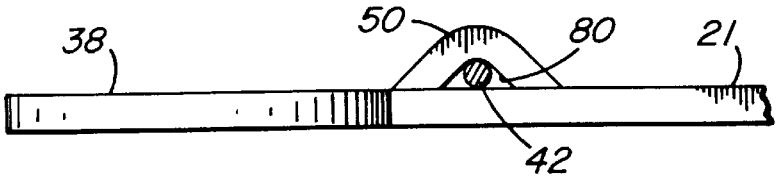
FIG. 5
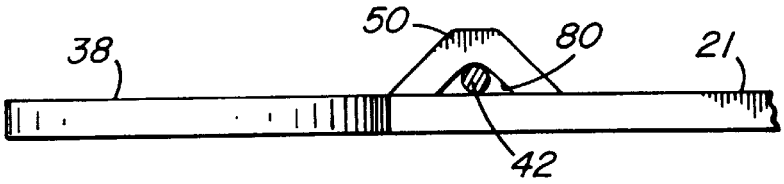
FIG. 6
FIG. 7A
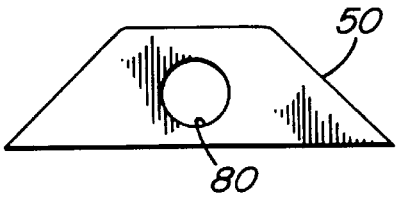
FIG. 7B
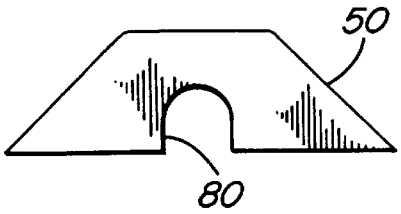
FIG. 7C
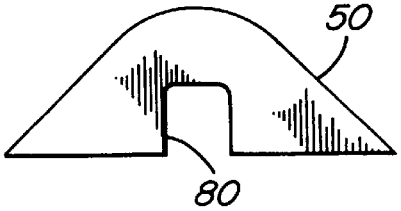

RECEPTACLE GROUNDING WIRE

FIELD OF THE INVENTION

The invention relates to grounding connections for use with wiring devices. More specifically, the present invention relates to a wiring device, such as a wall receptacle, having an improved ground connection between the mounting strap of the device and a screw that holds the receptacle in a standard outlet box.

BACKGROUND OF THE INVENTION

It is common practice to provide for the grounding of electrical appliances so that in the event of a circuit malfunction, for example, the exposed metallic portions of the appliance cannot reach a dangerous voltage. Consequently, many, if not most, electrical receptacles include a grounding contact through which the exposed metallic portions of the appliance can be connected to the system ground. Generally, this system ground is at the potential of the standard outlet box in which the receptacle or other wiring device is mounted. Since the grounding contact is usually electrically connected to or actually part of the mounting strap, such receptacles include some means for electrically connecting the mounting strap to the outlet box. The present invention provides an advantageous way of making this connection. For convenience, we refer to wiring devices, or receptacles in t his description. The invention is not limited to receptacles, but can be used on any wiring device having a mounting strap.

U.S. Pat. No. 3,432,793 (Muska) discloses various types of metallic clips capable of exerting a yieldable pressure on the shank of the screw used to fasten the wiring device to the outlet box. The Muska device is relatively simple and inexpensive, and provides the desired low resistance connection between the mounting strap and outlet box. However, the present invention is an improvement over the device illustrated and described in the Muska patent in that it is of even simpler construction, and thus easier to manufacture, and capable of providing a more secure contact with the screw shank. Hence, a superior connection can be made with this invention. Moreover, because of the relative simplicity of the present invention, assembly of the devices of the present invention are more easily adapted to automated manufacturing than devices illustrated in the Muska patent.

The invention can be implemented at very low cost. Wiring devices, such as receptacles are sold to consumers for very low prices, often under $0.50 and, therefore, the cost of manufacture is critical. Even a fraction of a cent reduction in cost can greatly affect market share.

SUMMARY OF THE INVENTION

This invention relates to a wiring device adapted to be mounted to a wall box. The device comprises: a mounting strap including a front surface and a back surface; a screw receiving aperture in the mounting strap extending through the front and back surfaces of the mounting strap, the aperture having a first side and a second side; first and second attachment members projecting from one of said front and back surfaces of the mounting strap, the first attachment member positioned adjacent the first side of the aperture, the second attachment member positioned adjacent the second side of the aperture; and a spring wire retained in openings in the first and second attachment members and extending across the aperture from its first side and second side.

The spring wire may extend across the aperture at a position off center with respect to the longitudinal center line of the aperture, whereby the aperture is divided into two openings separated by the spring wire, and the larger of the two openings has a height smaller than a shank of the screw received therein, so that the shank of the screw displaces the spring wire and is securely held in the opening.

Generally, the spring wire is linear before a screw is inserted in the screw receiving aperture, and the spring wire exerts a yieldable pressure on a screw inserted in the aperture to ensure a good grounding contact.

According to various embodiments, the attachment members are lugs integrally formed with the mounting strap, the lugs projecting from the front surface of the mounting strap, with the back surface of the mounting strap facing the wall box. The lugs may be crimped to ensure that the ends of the spring wire are secured in the openings thereof.

According to other embodiments, the invention provides a wiring device adapted to be mounted to a wall box, that comprises: a mounting strap including a first end and a second opposed end, a front surface and a back surface; screw receiving apertures extending through the front and back surfaces of the mounting strap at each of the first and second ends; a pair of attachment members adjacent each screw receiving aperture and projecting from the front surface of the mounting strap; and a spring wire extending across at least one screw receiving aperture, wherein ends of each spring wire are secured in openings in the first and second attachment members.

The invention also relates to a method of making a mounting strap for a wiring device. The method comprise: providing a mounting strap including a front surface and a back surface and a screw receiving aperture extending through the front and back surfaces of the mounting strap; cutting a pair of parallel lines in the mounting strap on each side of the screw receiving aperture; pressing cut sections formed between the pairs of parallel lines toward the front surface of the mounting strap, to form a pair of lugs integral with the mounting strap and projecting from its front surface; and inserting a spring wire through openings in the pair of lugs such that the spring wire extends across the screw receiving aperture between the lugs. The lugs may then be crimped to secure ends of the spring wire therein.

BRIEF OF THE DRAWING FIGURES

FIGS. 5 and 6 are partial side plan views of a wiring device after assembly with the spring wire.

FIGS. 7A, 7B and 7C are side views of alternate embodiments of attachment members for the spring wire.

DETAILED DESCRIPTION OF THE PREFERRED EMBODIMENTS

The invention is illustrated and described for use with a common duplex wall receptacle; however, the invention is not limited to any particular type of wiring device and may be used with any wiring device, such as a switch or other type of receptacle, where it is necessary or desirable to electrically connect a mounting strap or the like to an outlet box.

Figure 1:
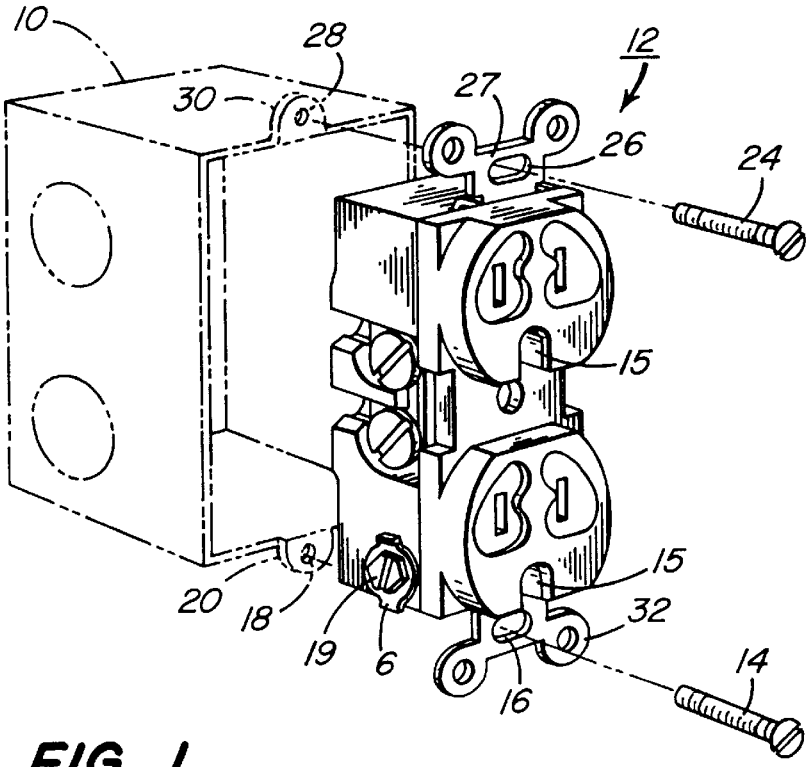
FIG. 1 illustrates a prior art duplex receptacle and wall box.

FIG. 1 shows a prior art exemplary duplex receptacle and wall box. The wall box 10 shown in phantom is mounted in the normal fashion in a wall to receive a wiring device such as a duplex receptacle 12. In normal use, the receptacle is mounted by passing a screw such as 14 through an opening 16 in the device mounting strap 32 and threading it into the threaded opening 18 in tab 20 formed integrally with wall box 10. An additional screw 24 is passed through opening 26 in bracket end 27 and into threaded hole 28 in tab 30. The receptacle is adapted to receive a three-prong plug, and the mounting strap 32 is electrically connected to the ground prong of the three-prong plug received in opening 15. Typically, mounting strap 32 is also electrically connected to ground plate 6 where grounding screw 19 is received; for example, the mounting strap, the connection to opening 15 and the ground plate are integrally formed of an electrically conductive, metallic material. Grounding screw 19 and ground plate 6 are adapted for connection with a grounding wire (not shown).

In some electrical wiring applications, wall box 10 is metallic and is grounded. If the screw is securely tightened, and the confronting surfaces of the mounting strap and the wall box are clean, a good ground can be obtained. However, if the screw is loose, or the confronting surfaces are not clean, the ground connection is provided by way of the screw. Therefore, a grounding connection may be made from the receptacle to the wall box provided there is a good grounding contact between the screws 14, 24, tabs 20, 30 of the wall box and the mounting strap of the receptacle. However, with reference to FIG. 1, screw 14 has a shank smaller than the size of the opening 16 in the mounting strap or bracket 32 of device 12. Thus, it is possible for the screw to be centrally positioned in the opening 16 while threaded into threaded opening 18 and to make no grounding contact with the mounting strap or any of the grounding portions of the device. Where grounding to a wall box is not assured, a grounding connection may be made at grounding screw 19, however, such connection is more awkward and time consuming, or may be overlooked by an installer of the receptacle.

By contrast, pursuant to this invention, satisfactory grounding contact between the screw and the mounting strap is ensured, as the grounding wire is pressed against and maintained in contact with the shank of the screw. The grounding contact is maintained by the spring pressure when the screw 24 threaded all the way into the opening 28, or even when it is only partially threaded into place.

Figure 2:
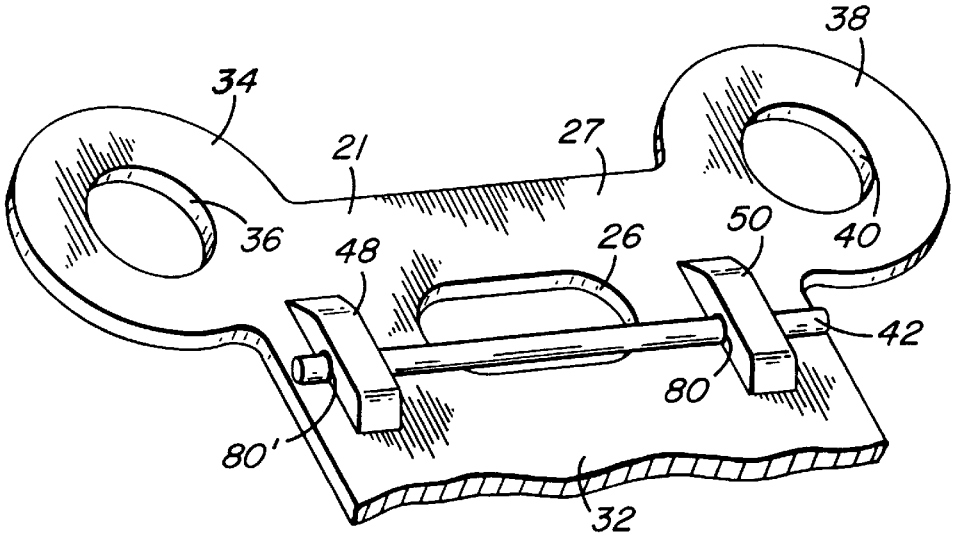
FIG. 2 is a partial, front perspective view of a wiring device according to a first embodiment of this invention.
Figure 3:
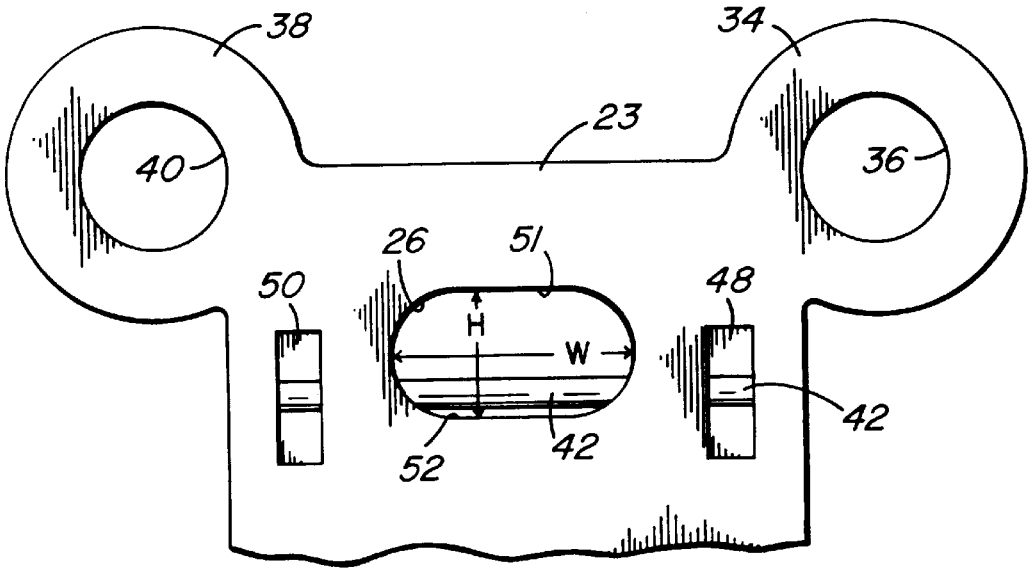
FIG. 3 is a partial, rear plan view of the wiring device of FIG. 2.

Referring to FIGS. 2 and 3, these figures illustrate a bracket end 27 of mounting strap or bracket 32 according to an embodiment of this invention. The opposite bracket end of the mounting strap, including opening 16 in which screw 14 is received, will generally correspond to end 27 shown in the figures. The mounting strap may be incorporated in a duplex wall receptacle as shown in FIG. 1, or in other wiring devices known in the art such as electrical switches.

The bracket end 27 of mounting strap 32 includes ears 34 and 38 having openings 36 and 40, respectively. The bracket end 27 further includes aperture 26 for passage of a screw 24, such that opening 26 is an aperture formed in and extending between front surface 21 and back surface 23 of the mounting strap. The opening 26 is preferably centered along the width of the bracket end 27. The opening 26 has a width W and a height H and may be in the shape of an oval as shown, although other shapes are within the scope of this invention, such as circular and rectangular shapes. The present invention involves placing a single piece of spring wire 42 completely across the opening 26 such that the spring wire extends in a widthwise direction with respect to mounting strap 32. In a preferred embodiment, the wire 42 is located height-wise within opening 26 at less than one-half height H. That is, the wire 42 traverses opening 26 at a position off center of the height of opening 26, and off center with respect to a longitudinal center line of opening 26, such that opening 26 is divided into two openings 51, 52.

Opening 51 is adapted to receive screw 24, and opening 51 has a height smaller than the diameter of the shank of screw 24. Also, the spring wire 42 preferably has a diameter such that the wire may engage with the threads on the shank of screw 24 when threaded through opening 51 into opening 28 of tab 30. Therefore, spring wire 42 exerts a yieldable pressure on the screw inserted in opening 51, and as it does so, the spring wire engages with threads on the screw. Preferably, spring wire 42 is initially in the form of a straight piece of wire, as in FIGS. 2 and 3.

To hold the spring wire 42 in position over the opening 26, wire attachment members 48, 50 are located on the front surface 21 of the mounting strap at each side of opening 26. In other words, attachment members 48, 50 are located at portions of the mounting strap 32 adjacent opening 26, intermediate of the outer edges of opening 26 and the adjacent outer edges of bracket end 27.

Figure 4:
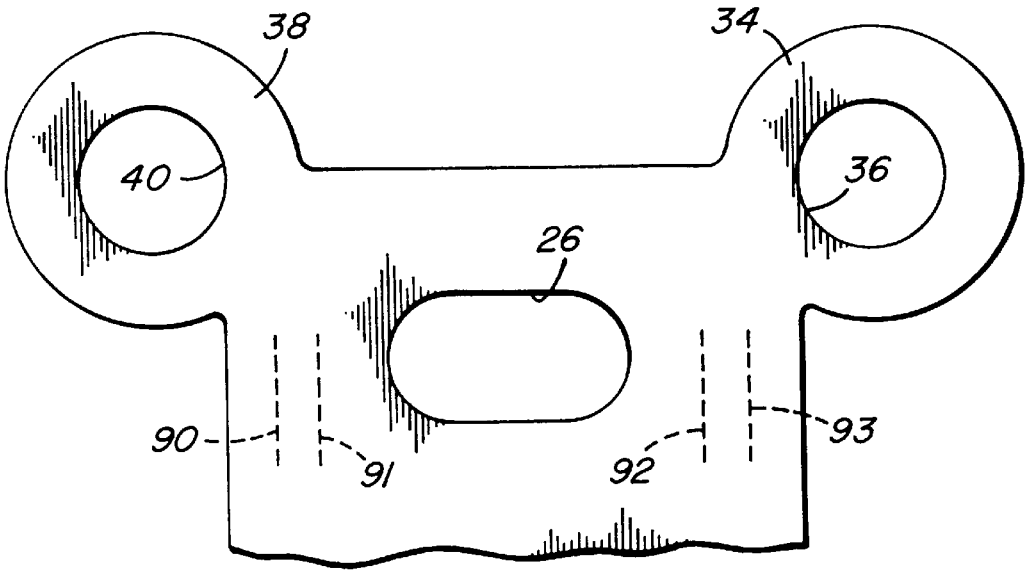
FIG. 4 is a partial front plan view of a wiring device prior to assembly with the spring wire.

The wire attachment members 48, 50 may have various shapes and may be made or attached to the mounting strap by various methods. For example, as illustrated in the various figures, the attachment members 48, 50 may have the form of a lug integrally formed with mounting strap 32 and including openings 80, 80' in which spring wire 42 is received. The lug 50 of FIGS. 5 and 6 may be formed as follows. Referring to FIG. 4, two sets of parallel cuts are made through the mounting strap along the lines indicated by dashed lines 90, 91, 92 and 93. Then, with the mounting strap placed on a support of a press with back surface 23 facing upward, lug 50 (and the corresponding lug 48 on the opposite side of opening 26) are formed by punching out the section between lines 90 and 91 and the section between lines 92 and 93 so that the lugs project from the front surface 21. At this point, openings 80, 80' are larger than the diameter of spring wire 42 so that the wire can be inserted easily therethrough. Spring wire 42 is then inserted through openings 80, 80'. Preferably, the lugs are then crimped to reduce the size of openings 80, 80' and so that the lugs bear upon and holds in place the spring wire at its ends.

FIG. 5 illustrates one resultant configuration of lug 50, where the integral lug projects from front surface 21 and has a generally triangular cross-sectional shape. FIG. 6 illustrates another resultant configuration of lug 50, where the integral lug has been deformed more from the crimping process and has a cross-sectional shape generally corresponding to a trapezoid (this latter embodiment being visible in FIG. 2).

An advantage of these aspects of the invention is that the assembly of the spring wire to the mounting strap is more easily adapted to automated manufacturing processes. For example, a wiring device with a mounting strap having the general form as in FIG. 4 may be transferred, for example by a pick-and-place mechanism, to a station where lines 90, 91, 92 and 93 are cut. The device may be transferred to a station including a press for forming the integral lugs, then to a station where a straight spring wire is inserted in the lug openings, and finally to a station where the lugs are crimped to secure the spring wire in the lugs. This is in contrast to more complex constructions as in aforementioned U.S. Pat. No. 3,432,793.

If desired, however, attachment members can have alternate configurations and be formed by different methods. For example, as shown in FIGS. 7A, 7B and 7C, various lugs 50 may be preformed, for example, of a metal such as steel, and bonded to front surface 21 of the mounting strap, for example, by soldering. Spring wire 42 may then be inserted through openings 80 and 80', and the lugs may be crimped to secure the spring wire therein.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed, but that the invention will include all embodiments falling within the scope and spirit of the appended claims.

What is claimed is:

1. A wiring device which is adapted to be mounted to a wall box, comprising:

a mounting strap including a front surface and a back surface;

a screw receiving aperture in the mounting strap extending through the front and back surfaces of the mounting strap, the aperture having a first side and a second side;

first and second attachment members projecting from one of said front and back surfaces of the mounting strap, the first attachment member positioned adjacent the first side of the aperture, the second attachment member positioned adjacent the second side of the aperture; and a spring wire retained in openings in the first and second attachment members and extending across the aperture from its first side and second side.

2. The device of claim 1, wherein the spring wire extends across the aperture at a position displaced from a center line of the aperture, whereby the aperture is divided into two openings separated by the spring wire.

3. The device of claim 2, wherein a larger of the two openings has a height smaller than a shank of the screw received therein.

4. The device of claim 1, wherein the spring wire exerts a yieldable pressure on a screw inserted in the aperture.

5. The device of claim 4, wherein the spring wire is linear before a screw is inserted in the aperture.

6. The device of claim 1, wherein the attachment members are lugs integrally formed with the mounting strap.

7. The device of claim 6, wherein the lugs project from the front surface of the mounting strap.

8. The device of claim 7, wherein the spring wire abuts the front surface of the mounting strap between the lugs and the screw receiving aperture.

9. The device of claim 6, wherein the lugs have a generally triangular cross-sectional shape with the opening therethrough in which the spring wire is retained.

10. The device of claim 6, wherein the lugs have a generally trapezoidal cross-sectional shape with the opening therethrough in which the spring wire is retained.

11. The device of claim 6, wherein the lugs are crimped to secure ends of the spring wire in the openings thereof.

12. The device of claim 1, wherein the mounting strap includes a first end and an opposed second end, each of the first and second ends comprising:

a screw receiving aperture extending through the front and back surfaces of the mounting strap, the aperture having a first side and a second side;

first and second attachment members projecting from one of said front and back surfaces of the mounting strap, the first attachment member positioned adjacent the first side of the aperture, the second attachment member positioned adjacent the second side of the aperture; and a spring wire retained in openings in the first and second attachment members and extending across the aperture from its first side and second side.

13. A wiring device adapted to be mounted to a wall box, comprising:

a mounting strap including a first end and a second opposed end, a front surface and a back surface;

screw receiving apertures extending through the front and back surfaces of the mounting strap at each of the first and second ends;

a pair of attachment members adjacent each screw receiving aperture and projecting from the front surface of the mounting strap; and a spring wire extending across at least one screw receiving aperture, wherein ends of each spring wire are secured in openings in the first and second attachment members.

14. A method of making a mounting strap for a wiring device, comprising:

providing a mounting strap including a front surface and a back surface and a screw receiving aperture extending through the front and back surfaces of the mounting strap;

cutting a pair of parallel lines in the mounting strap on each side of the screw receiving aperture;

pressing cut sections formed between the pairs of parallel lines toward the front surface of the mounting strap, to form a pair of lugs integral with the mounting strap and projecting from its front surface; and inserting a spring wire through openings in the pair of lugs such that the spring wire extends across the screw receiving aperture between the lugs.

15. The method of claim 14, further comprising crimping the lugs to secure ends of the spring wire therein.

* * * * *